US005772848A

United States Patent [19]

Dutt

[11] Patent Number: 5,772,848

[45] Date of Patent: Jun. 30, 1998

[54] BRAIDED BASE FABRICS FOR SHOE PRESS BELTS

[75] Inventor: William H. Dutt, Wynantskill, N.Y.

[73] Assignee: Albany International Corp., Albany, N.Y.

[21] Appl. No.: 759,040

[22] Filed: Dec. 3, 1996

[51] Int. Cl.[6] ..... D21F 3/02

[52] U.S. Cl. ..... 162/358.4; 162/901; 198/847

[58] Field of Search ..... 162/358.4, 901; 198/846, 847; 87/8

[56] References Cited

U.S. PATENT DOCUMENTS

| | | | |
|---|---|---|---|
| 4,482,430 | 11/1984 | Majaniem | 162/901 |
| 4,946,731 | 8/1990 | Dutt | 162/901 |
| 5,062,924 | 11/1991 | McCarten et al. | 162/358.4 |
| 5,196,092 | 3/1993 | Stigberg | 162/901 |
| 5,238,537 | 8/1993 | Dutt | 162/901 |
| 5,242,743 | 9/1993 | Nakanishi et al. | 428/222 |
| 5,298,124 | 3/1994 | Eklund et al. | 162/358.4 |
| 5,357,839 | 10/1994 | Brookstein et al. | 87/8 |
| 5,397,277 | 3/1995 | Doring | 474/153 |

*Primary Examiner*—Karen M. Hastings
*Attorney, Agent, or Firm*—Kane, Dalsimer, Sullivan, Kurucz, Levy, Eisele and Richard, LLP

[57] ABSTRACT

A resin-impregnated endless belt for a long nip press or calender of the shoe type has a base fabric in the form of a multilayer braided structure wherein each of the constituent layers are connected to those adjacent thereto by at least one interlocking yarn to inhibit interlayer delamination. The base fabric is in the form of an endless loop, at least the inner surface of which is coated with a polymeric resin material, such as polyurethane. The polymeric resin material impregnates the structure of the base fabric, rendering it impermeable to oil and water.

13 Claims, 6 Drawing Sheets

12
20
20
10
18
18
14
16

BRAIDED BASE FABRICS FOR SHOE PRESS BELTS

BACKGROUND OF THE INVENTION

1. Field of the Invention

The present invention relates to mechanisms for extracting water from a web of material, and more particularly from a fibrous web being processed into a paper product on a papermaking machine. Specifically, the present invention is an impermeable belt designed for use on a long nip press on a papermaking machine. The belt may also be used in other papermaking and paper-processing applications, such as calendering.

2. Description of the Prior Art

During the papermaking process, a fibrous web is formed on a forming wire by depositing a fibrous slurry thereon. A large amount of water is drained from the slurry during this process, after which the newly formed web proceeds to a press section. The press section includes a series of press nips, in which the fibrous web is subjected to compressive forces designed to remove water therefrom. The web finally proceeds to a drying section which includes heated dryer drums around which the web is directed. The heated dryer drums reduce the water content of the web to a desirable level through evaporation.

Rising energy costs have made it increasingly desirable to remove as much water as possible from the web prior to its entering the dryer section. The dryer drums are often heated from within by steam and related costs can be substantial especially when a large amount of water needs to be removed from the web.

Traditionally, press sections have included a series of nips formed by pairs of adjacent cylindrical press rolls. In recent years, the use of long press nips has been found to be advantageous over the use of nips formed by pairs of adjacent press rolls. The longer the time a web can be subjected to pressure in the nip, the more water can be removed there, and, consequently, the less water will remain behind in the web for removal through evaporation in the dryer section.

The present invention relates to long nip presses of the shoe type. In this variety of long nip press, the nip is formed between a cylindrical press roll and an arcuate pressure shoe. The latter has a cylindrically concave surface having a radius of curvature close to that of the cylindrical press roll. When the roll and shoe are brought into close physical proximity to one another, a nip is formed which can be five to ten times longer in the machine direction than one formed between two press rolls. This increases the so-called dwell time of the fibrous web in the long nip while maintaining the same level of pressure per square inch in pressing force used in a two-roll press. The result of this new long nip technology has been a dramatic increase in dewatering of the fibrous web in the long nip when compared to conventional nips on paper machines.

A long nip press of the shoe type requires a special belt, such as that shown in U.S. Pat. No. 5,238,537. This belt is designed to protect the press fabric supporting, carrying and dewatering the fibrous web from the accelerated wear that would result from direct, sliding contact over the stationary pressure shoe. Such a belt must be provided with a smooth, impervious surface that rides, or slides, over the stationary shoe on a lubricating film of oil. The belt moves through the nip at roughly the same speed as the press fabric, thereby subjecting the press fabric to minimal amounts of rubbing against the surface of the belt.

Belts of the variety shown in U.S. Pat. No. 5,238,537 are made by impregnating a woven base fabric, which takes the form of an endless loop, with a synthetic polymeric resin. Preferably, the resin forms a coating of some predetermined thickness at least on the inner surface of the belt, so that the yarns from which the base fabric is woven may be protected from direct contact with the arcuate pressure shoe component of the long nip press. It is specifically this coating which must have a smooth, impervious surface to slide readily over the lubricated shoe and to prevent any of the lubricating oil from penetrating the structure of the belt to contaminate the press fabric, or fabrics, and fibrous web.

The base fabric of the belt shown in U.S. Pat. No. 5,238,537 may be woven from monofilament yarns in a single- or multi-layer weave, and is woven so as to be sufficiently open to allow the impregnating material to totally impregnate the weave. This eliminates the possibility of any voids forming in the final belt. Such voids may allow the lubrication used between the belt and shoe to pass through the belt and contaminate the press fabric or fabrics and fibrous web.

When the impregnating material is cured to a solid condition, it is primarily bound to the base fabric by a mechanical interlock, wherein the cured impregnating material surrounds the yarns of the base fabric. In addition, there may be some chemical bonding or adhesion between the cured impregnating material and the material of the yarns of the base fabric.

While the belts shown in U.S. Pat. No. 5,238,537 have proved to be durable, reliable and long-lived on long nip presses, improvements both in the structure of such belts and in methods for their manufacture are continually being made. Some of the improvements are driven by the need to prevent the polymeric resin coating from delaminating from the base fabric and relate to means for improving the mechanical, and possibly chemical, interlock between the base fabric and the coating. Other improvements relate to the structure of the base fabrics themselves, and are designed to make the base fabrics stronger, more durable, or to the exact dimensional specifications required for a given application. Still other improvements relate to the coating processes themselves, and have as their object the complete impregnation of the base fabric and the provision of a uniformly thick coating of polymeric resin material on the inner surface of its endless configuration without the step of inverting (turning inside out) the belt during the manufacturing process.

The present invention relates to the base fabric of a long nip press belt. More specifically, the present invention is a long nip press belt having a base fabric in the form of an endless braided structure. In addition to being useful as a long nip press belt, the present invention may also be used in other papermaking and paper-processing applications, such as calendering.

SUMMARY OF THE INVENTION

Accordingly, the present invention is a resinimpregnated endless belt for a long nip press. The belt may also be used on a calender of the shoe type, as both a long nip press and a calender of that type comprise a cylindrical press roll and an arcuate pressure shoe which together define a nip therebetween. The resin-impregnated endless belt passes through the nip in direct sliding contact with the arcuate pressure shoe, and separates a fibrous web being treated there, and perhaps a press fabric or fabrics supporting the fibrous web, from the arcuate pressure shoe, thereby protecting the fibrous web, and the press fabric or fabrics, from damage by direct sliding contact with the arcuate pressure shoe and from contamination by any lubricant on the arcuate pressure shoe.

The resin-impregnated endless belt comprises a base fabric in the form of a braided structure having a plurality of braided layers of yarns. In each of the layers at least one yarn thereof extends into a contiguous layer to form an interlock therebetween. The layers are therefore interlocked with one another, and are unable to delaminate from one another. The base fabric is in the form of an endless loop having an inner surface, an outer surface, a longitudinal direction and a transverse direction, and is assembled according to the teachings of commonly assigned U.S. Pat. No. 5,501,133 to Brookstein et al. This patent was issued on Mar. 26, 1996 and is entitled "Apparatus for Making a Braid Structure".

At least the inner surface of the base fabric has a coating of a polymeric resin material, such as polyurethane. The coating impregnates the base fabric and renders it impermeable to liquids, such as oil and water, and is ground and buffed to provide it with smooth surface, and the belt with a uniform thickness.

The present invention will now be described in more complete detail with frequent reference being made to the figures, which are listed and identified as follows.

DETAILED DESCRIPTION OF THE PREFERRED EMBODIMENTS

Figure 1:
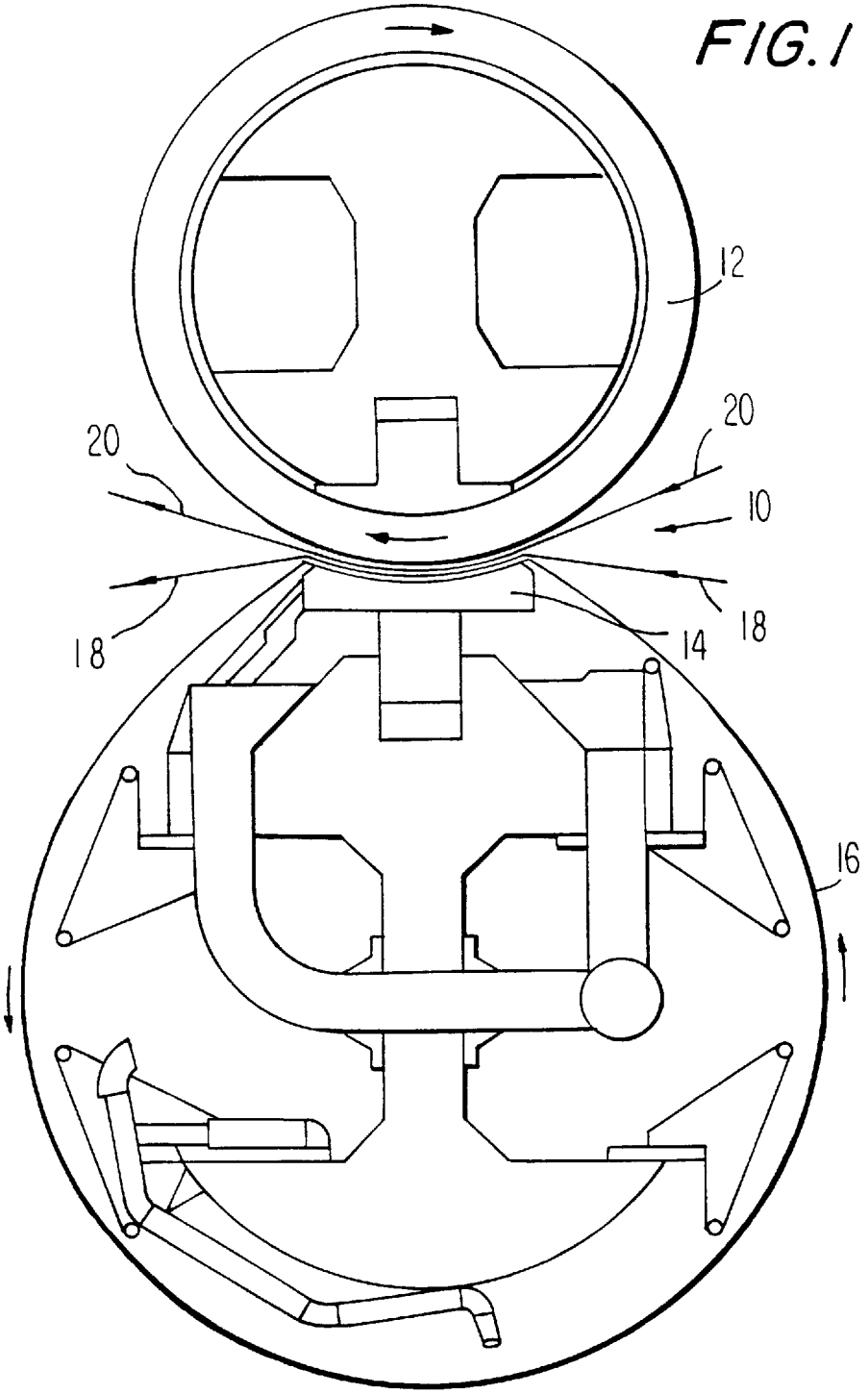
FIG. 1 is a side cross-sectional view of a long nip press.

A long nip press for dewatering a fibrous web being processed into a paper product on a paper machine is shown in a side cross-sectional view in FIG. 1. The press nip 10 is defined by a smooth cylindrical press roll 12 and an arcuate pressure shoe 14. The arcuate pressure shoe 14 has about the same radius of curvature as the cylindrical press roll 12. The distance between the cylindrical press roll 12 and the arcuate pressure shoe 14 may be adjusted by hydraulic means operatively attached to arcuate pressure shoe 14 to control the loading of the nip 10. Smooth cylindrical press roll 12 may be a controlled crown roll matched to the arcuate pressure shoe 14 to obtain a level cross-machine nip profile.

Long nip press belt 16 extends in a closed loop through nip 10, separating cylindrical press roll 12 from arcuate pressure shoe 14. A wet press fabric 18 and a fibrous web 20 being processed into a paper sheet pass together through nip 10 as indicated by the arrows in FIG. 1. Fibrous web 20 is supported by wet press fabric 18 and comes into direct contact with smooth cylindrical press roll 12 in nip 10. Fibrous web 20 and wet press fabric 18 proceed through the nip 10 as indicated by the arrows. Long nip press belt 16, also moving through press nip 10 as indicated by the arrows, that is, counterclockwise as depicted in FIG. 1, protects wet press fabric 18 from direct sliding contact against arcuate pressure shoe 14, and slides thereover on a lubricating film of oil. Long nip press belt 16, accordingly, must be impermeable to oil, so that wet press fabric 18 and fibrous wet 20 will not be contaminated thereby.

Figure 2:
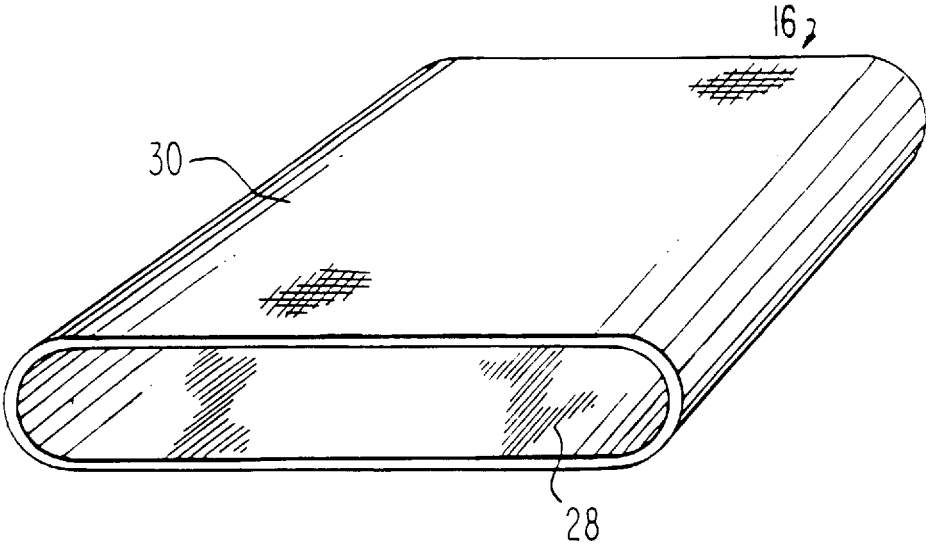
FIG. 2 is a perspective view of a belt of the present invention.

A perspective view of the long nip press belt 16 is provided in FIG. 2. The belt 16 has an inner surface 28 and an outer surface 30. On the outer surface 30, the base fabric of the belt 16 may be visible.

Figure 3:
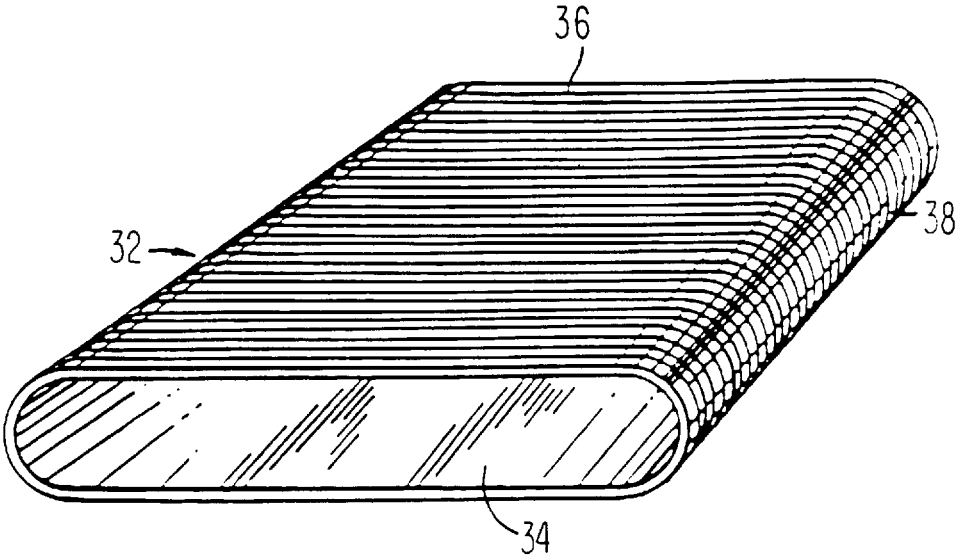
FIG. 3 is a perspective view of an alternate embodiment of the belt.

FIG. 3 is a perspective view of an alternate embodiment of the belt 32. The belt 32 has an inner surface 34 and an outer surface 36. The outer surface 36 is provided with a plurality of grooves 38, for example, in the longitudinal direction around the belt 32 for the temporary storage of water pressed from fibrous web 20 in press nip 10.

Figure 4:
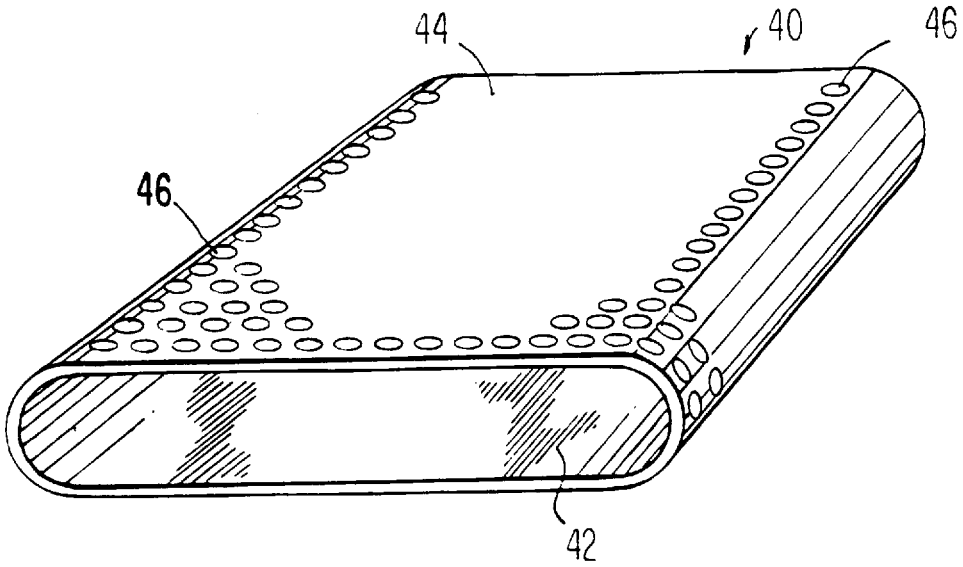
FIG. 4 is a perspective view of another embodiment of the belt.

Alternatively, the outer surface of the belt may be provided with a plurality of blind holes arranged in some desired geometric pattern for the temporary storage of water. FIG. 4 is a perspective view of such an alternate embodiment of the belt 40. The belt 40 has an inner surface 42 and an outer surface 44. The outer surface 44 is provided with a plurality of blind holes 46, so called because they do not extend completely through the belt 40.

The long nip press belts 16, 32, 40 of the present invention include a base fabric which is a braided structure. The braided structure comprises a plurality of braided layers of yarns in which the layers are laid down in a single pass of a braiding machine, with at least one yarn of each layer extending into a contiguous layer to form an interlock between the layers.

The braided structure of the base fabrics may be manufactured according to the teachings of commonly assigned U.S. Pat. No. 5,501,133 (the '133 patent) to Brookstein et al., entitled "Apparatus for Making a Braid Structure", the teachings of which are incorporated herein by reference. The '133 patent shows a multilayer braided structure in which the layers are interbraided. The interbraiding of the layers provides an interlock therebetween which prevents the delamination of multiple braided layers from one another.

The interlock between the layers may be a direct interlock in which the interlocking yarn passes from a first layer to a contiguous second layer, and passes around at least one yarn in the second layer.

Alternatively, the interlock between the layers may be an indirect interlock in which an interlocking yarn passes from the first layer through the second layer to another, not necessarily contiguous, layer in the structure, and passes around a strand in the other layer to serve to bind the first layer and the other layer together and at the same time to bind the layers therebetween.

To manufacture a base fabric for a long nip press belt, the braided structure may be of a hollow, tubular form. In view of the fact that long nip press belts, depending on the size requirements of the long nip presses on which they are installed, have lengths from roughly 10 to 40 feet (approximately 3 to 12 meters), measured longitudinally around their endless-loop forms, and widths from roughly 100 to 450 inches (approximately 250 to 1125 centimeters), measured transversely across those forms, the production of the base fabric may require a cylindrical braiding mandrel having a diameter from roughly 3 to 12 feet (approximately 1 to 4 meters) and a length from roughly 100 to 450 inches (approximately 250 to 1125 centimeters).

The multilayer braided structure of the base fabric is made by feeding a plurality of yarns from a first set of movable package carriers to a braid-forming area to form a braid layer thereat in which each movable package carrier traverses a predetermined first serpentine path, and by feeding a plurality of yarns from a second set of movable package carriers to the braid-forming area to form a braid layer thereat in which each movable package carrier of the second set traverses a predetermined second serpentine path, wherein each of the serpentine paths is arranged so that at least one package carrier of each set can carry a yarn from its respective layer into the other layer to interlock with the other layer.

As noted above, the second layer may be contiguous to the first layer. Alternatively, the second layer may be spaced from the first layer and have a number of intermediate layers interposed therebetween. In such circumstances, a yarn associated with the package carrier moving between the first and second layers is used to pass through all the intermediate layers prior to forming a positive interlock with the second layer.

Yarns from static package carriers may also be fed to the braid-forming area between two or more layers for interbraiding with the yarns from the respective movable package carriers. The yarns fed from static package carriers maintain a longitudinal or axial orientation with respect to the cylindrical braiding mandrel. In this way, the base fabric may be provided with reinforcement yarns lying in the transverse, or cross-machine, direction of the belt. Such reinforcement is useful where the belt is of the "press jacket" variety held by clamping rings on the widthwise edges of the press.

The cylindrical braiding mandrel may be positioned in the braid-forming area in order to form the requisite hollow braid structure. The first layer of the braid is then formed on the mandrel and second, and subsequent, layers are formed over the first layer. The mandrel may be moved through the braidforming area as braiding takes place so that a continuous hollow braided structure is built up thereon. All of the layers of the multilayer braided structure are laid down in one pass of the mandrel through the braiding machine.

The plurality of package carriers and serpentine paths are arranged on the internal surface of a tubular braiding machine, the internal surface having a plurality of serpentine paths formed therein. Movable package carriers traverse the serpentine paths; static package carriers are fixed on the internal surface of the tubular braiding machine.

The braid-forming area is preferably situated at the longitudinal axis of the tubular braiding machine and, as the braided structure is formed, it, or, more specifically, the cylindrical braiding mandrel is moved through the tubular braiding machine along the longitudinal axis thereof.

For use as the base fabric for a long nip press belt, the braided structure preferably consists of yarns which make an angle of 85° or more to the longitudinal axis of the cylindrical braiding mandrel. In other words, the yarns of the base fabric will define left-handed and right-handed intertwined spirals each making an angle of 5° or less with respect to the machine direction of the long nip press belt. This will make it less likely that the long nip press belt will distort in response to tension applied in the machine direction, and can be accomplished by minimizing the number of movable package carriers used to make the braided structure.

Figure 5:
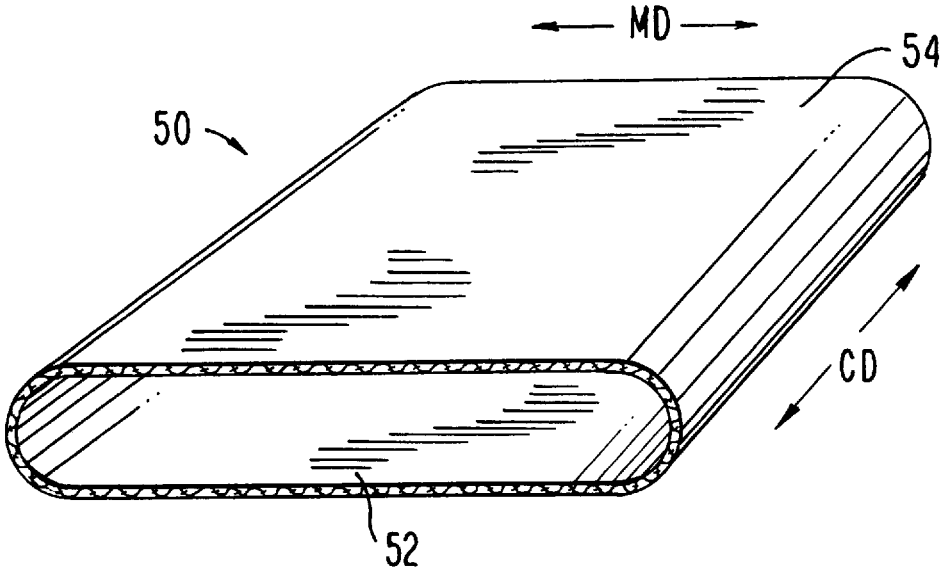
Figure 5 is a perspective view of the base fabric for the belt of the present invention.

Figure 5 is a perspective view of the base fabric 50 for the belts of the present invention. The base fabric 50 is in the form of an endless loop and has an inner surface 52 and an outer surface 54. The longitudinal, or machine, direction is indicated as "MD" in FIG. 5, while the transverse, or cross-machine, direction is indicated as "CD".

Figure 6:
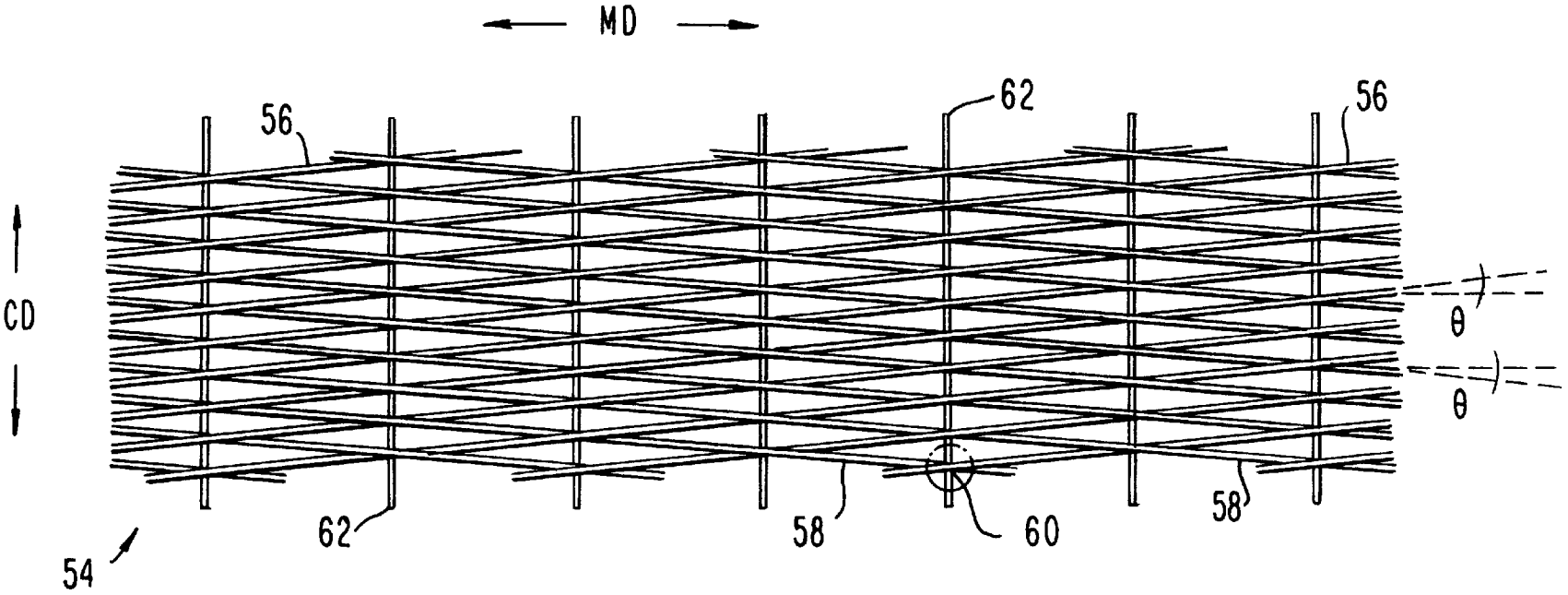
FIG. 6 is a plan view of an area of the outer surface of the base fabric.

FIG. 6 is a plan view of an area of the outer surface 54 of the base fabric 50. Some of the yarns 56 define right-handed spirals; other yarns 58 define left-handed spirals. Yarns 56,58 spiral continuously about the base fabric 50 at a small angle relative to the longitudinal, or machine, direction (MD) thereof, and preferably make an angle θ less than 5° relative to the longitudinal direction. Accordingly, at crossing points 60, yarns 56,58 make an angle of 10° or less relative to each other. Reinforcing yarns 62, which lie in the transverse, or cross-machine, direction (CD) are interbraided with the spiralling yarns 56,58.

Figure 7:
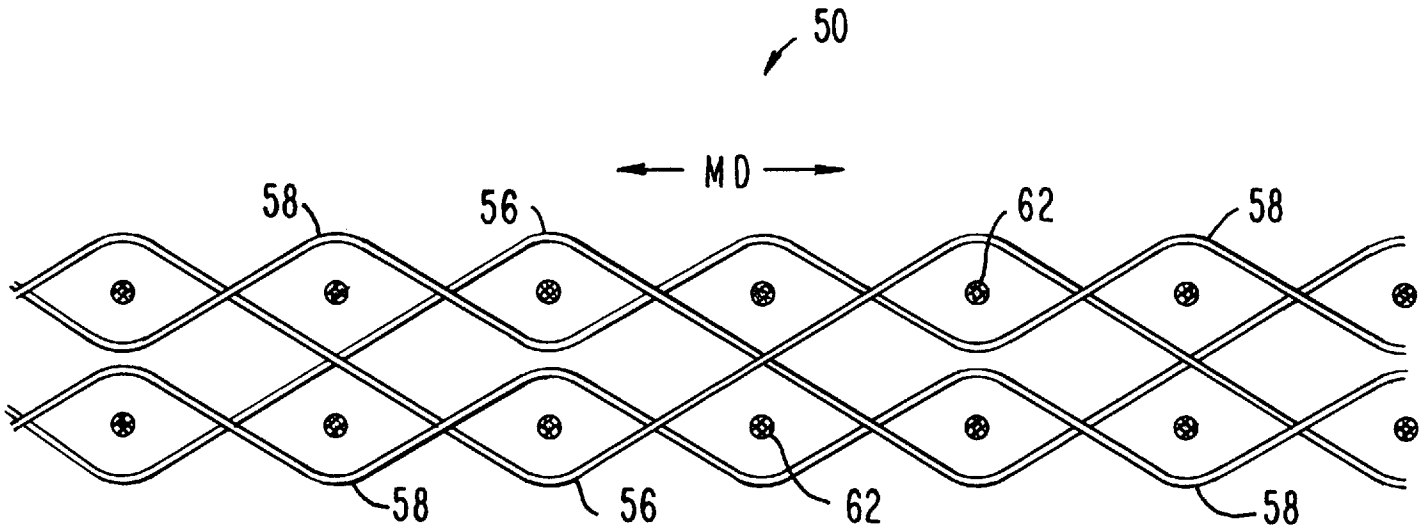
FIG. 7 is a schematic cross-sectional view taken in the longitudinal, or machine, direction of the base fabric.

FIG. 7 is a schematic cross-sectional view of the base fabric 50 taken in the longitudinal, or machine, direction (MD) thereof. Referring to the preceding discussion, base fabric 50, as shown in FIG. 7, comprises two braided layers of yarns defined by yarns 58 which define left-handed spirals about the base fabric 50. Yarns 56, which define right-handed spirals about the base fabric 50, pass back and forth between the two braided layers to interlock them together. Reinforcing yarns 62 are directed transversely across the base fabric 50 within its braided structure.

The base fabric may be produced from any of the yarn varieties used by those of ordinary skill in the art to produce papermachine clothing. Monofilament yarns are preferred, although plied monofilament, multifilament and plied multifilament yarns may also be used. The yarns may be of any of the polymeric resins from which yarns for papermachine clothing are commonly extruded, such as polyamide, polyester, polyetheretherketone (PEEK), polyaramid and polyolefin resins.

The braided structure of the base fabric must be of an openness sufficient to ensure its complete impregnation by the polymeric resin material with which it is to be coated. Complete impregnation eliminates the possibility of undesirable voids forming in the finished belt. Voids are particularly undesirable because they may allow the lubricating oil used between the belt and the arcuate pressure shoe to pass through the belt and contaminate the press fabric 18, or press fabrics, and fibrous wet 20 being processed into paper.

When the braiding of the base fabric has been completed, it may be removed from the cylindrical braiding mandrel and coated with a polymeric resin material using techniques well-known in the art. Alternatively, the coating may be carried out, at least in part, while the base fabric is still on the cylindrical braiding mandrel.

The polymeric resin material is applied to at least one surface of the base fabric, that surface being the one which will ultimately be the inner surface of the belt. As the inner surface slides across the lubricated arcuate pressure shoe 14, the coating of polymeric resin material protects the base fabric from such sliding contact and the wear by abrasion that would otherwise result. The polymeric resin material also impregnates the base fabric and renders the belt impermeable to oil and water. The polymeric resin material may be polyurethane, and, if so, is preferably a 100% solids composition thereof to avoid the formation of bubbles during the curing process through which the polymeric resin proceeds following its application onto the base fabric. After curing, the coating of polymeric resin material is ground and buffed to provide the belt with a smooth surface and a uniform thickness.

Alternatively, both surfaces of the base fabric may be coated with a polymeric resin material. Following the curing of the polymeric resin material, both the inner surface and the outer surface of the belt may be ground and buffed to provide the belt with smooth surfaces and a uniform thickness. Finally, the outer surface may be provided, by cutting, scoring, graving or drilling, with a plurality of grooves, for example, in the longitudinal direction around the belt, or blind holes for the temporary storage of water press from fibrous web 20 in the press nip 10.

It will be recognized that modifications to the above would be obvious to anyone of ordinary skill in the art without departing from the scope of the claims appended hereinbelow.

What is claimed is:

1. A resin-impregnated endless impermeable press belt in a long nip shoe press or calender, or for other papermaking and paper-processing applications, said resin-impregnated endless belt comprising:

a base fabric, said base fabric being a braided structure having a plurality of braided layers of yarns, wherein in each of said layers at least one yarn thereof extends into a contiguous layer to form an interlock therebetween, said base fabric being in the form of an endless loop with an inner surface, an outer surface, a longitudinal direction and a transverse direction; and a coating of a polymeric resin material on at least said inner surface of said base fabric, said coating impregnating and rendering said base fabric impermeable to liquids, said coating being smooth and providing said belt with a uniform thickness.

2. A belt as claimed in claim 1 wherein said coating of a polymeric resin material is on both said inner surface and said outer surface of said base fabric.

3. A belt as claimed in claim 1 wherein said polymeric resin material is polyurethane.

4. A belt as claimed in claim 1 wherein said yarns are of a polymeric resin material selected from the group consisting of polyamide, polyester, polyetheretherketone (PEEK), polyaramid and polyolefin resins.

5. A belt as claimed in claim 1 wherein said yarns are of any of the varieties selected from the group consisting of monofilament, plied monofilament, multifilament and plied multifilament yarns.

6. A belt as claimed in claim 1 wherein said yarns make an angle of 5° or less with the longitudinal direction of said base fabric.

7. A belt as claimed in claim 1 further comprising a plurality of reinforcing yarns, said reinforcing yarns extending in said transverse direction of said base fabric between at least one pair of said layers of yarns.

8. A belt as claimed in claim 1 wherein said reinforcing yarns are of a polymeric resin material selected from the group consisting of polyamide, polyester, polyetheretherketone (PEEK), polyaramid and polyolefin resins.

9. A belt as claim in claim 1 wherein said reinforcing yarns are of any of the varieties selected from the group consisting of monofilament, plied monofilament, multifilament and plied multifilament yarns.

10. A belt as claimed in claim 1 wherein said coating on said inner surface of said base fabric is ground and buffed to give said belt a uniform thickness and desired surface characteristics.

11. A belt as claimed in claim 2 wherein said coating on both said inner and outer surfaces is ground and buffed to give said belt a uniform thickness and desired surface characteristics.

12. A belt as claimed in claim 2 wherein said coating on said outer surface of said belt includes a plurality of grooves, said coating, apart from said grooves, providing said belt with a uniform thickness.

13. A belt as claimed in claim 2 wherein said coating on said outer surface of said belt includes a plurality of blind holes, said coating, apart from said blind holes, providing said belt with a uniform thickness.

* * * * *